US005405629A

United States Patent [19]

Marnocha et al.

[11] Patent Number: 5,405,629

[45] Date of Patent: Apr. 11, 1995

[54] MULTI-SEAL RECLOSABLE FLEXIBLE PACKAGE FOR DISPLAYING THINLY SLICED FOOD PRODUCTS

[75] Inventors: Todd S. Marnocha, Sun Prairie; Brian P. Lawless, Madison; Gerald O. Hustad, McFarland, all of Wis.

[73] Assignee: Oscar Mayer Foods Corporation, Madison, Wis.

[21] Appl. No.: 192,317

[22] Filed: Feb. 4, 1994

Related U.S. Application Data

[63] Continuation of Ser. No. 930,491, Aug. 14, 1992, abandoned, which is a continuation of Ser. No. 609,296, Nov. 5, 1990, abandoned, which is a continuation-in-part of Ser. No. 505,329, Apr. 5, 1990, abandoned.

[51] Int. Cl.[6] ..... B65D 85/00; B65D 73/02; B65D 33/34

[52] U.S. Cl. ..... 426/122; 206/466; 206/484; 206/806; 206/807; 383/5; 383/61; 383/65; 426/123; 426/126; 426/129; 426/130

[58] Field of Search ..... 426/122, 123, 126, 129, 426/130; 206/484, 466, 45.34, 806, 807; 383/5, 61, 63, 65

[56] References Cited

U.S. PATENT DOCUMENTS

| | | | |
|---|---|---|---|
| D. 299,085 | 12/1988 | Martinez . | |
| 2,596,514 | 4/1950 | Uehlein . | |
| 2,793,745 | 5/1957 | Cox, Jr. . | |
| 3,051,583 | 8/1962 | Tindall . | |
| 3,191,849 | 6/1965 | Gutowski et al. . | |
| 3,338,723 | 8/1967 | Lundquist | 229/3.5 R X |
| 3,371,848 | 3/1968 | Ward et al. | 206/621 |
| 3,395,788 | 8/1968 | Gill . | |
| 3,467,244 | 9/1969 | Mahaffy et al. . | |
| 3,486,615 | 12/1969 | De Woskin | 206/45.34 |
| 3,502,486 | 3/1970 | Lundquist | 206/45.34 |
| 3,556,292 | 1/1971 | Krzyzanowski | 206/621 X |
| 3,556,337 | 1/1971 | Harmon et al. . | |
| 3,559,799 | 2/1971 | Kramer et al. | 206/45.34 |
| 3,647,485 | 3/1972 | Seiferth et al. . | |
| 3,873,735 | 3/1975 | Chalin et al. . | |
| 4,018,905 | 4/1977 | Adamek et al. . | |
| 4,246,288 | 1/1981 | Sanborn, Jr. . | |
| 4,268,530 | 5/1981 | Wyslotsky | 426/129 X |
| 4,599,849 | 7/1986 | Lundstrom . | |
| 4,691,820 | 9/1987 | Martinez . | |
| 4,782,951 | 11/1988 | Griesbach et al. | 206/484 |
| 4,823,961 | 2/1989 | Griesbach et al. | 206/632 |
| 4,866,911 | 9/1989 | Grindrod et al. . | |
| 4,896,775 | 1/1990 | Boeckmann et al. | 220/359 X |
| 4,923,309 | 5/1990 | Van Erden | 383/5 |
| 4,944,603 | 7/1990 | Cornish et al. | 383/5 |
| 4,966,470 | 10/1990 | Thompson et al. | 383/61 |
| 4,986,673 | 1/1991 | Bell | 383/61 |
| 5,005,707 | 4/1991 | Hustad et al. | 206/632 |

FOREIGN PATENT DOCUMENTS

| | | |
|---|---|---|
| 385323 | 9/1990 | European Pat. Off. . |
| 450958 | 10/1991 | European Pat. Off. . |
| 452052 | 10/1991 | European Pat. Off. . |
| 1544040 | 9/1968 | France . |

OTHER PUBLICATIONS

*World Patent Index*, Access Number 82-23307e, Derwent Publications Ltd., London GB; & JP-A-57 028 777 (Kishimoto) 16 Feb. 1982.

*Primary Examiner*—Bryon P. Gehman

*Attorney, Agent, or Firm*—Lockwood, Alex, Fitzgibbon & Cummings

[57] ABSTRACT

A multi-seal flexible recloseable package having a tapered product cavity formed in one of the package sidewalls has a generally wedged-shaped cavity into which a doubled-over shingled stack of the food product slices are sealed. The package has a first, peelable hermetic seal located next to an access edge of the product cavity and a second, recloseable seal positioned directly above the peelable seal. Vertical extensions of the package sidewalls are sealed together at their tops to form a third package seal which has a tamper-evident tear strip. One or more openings in the vertical package extensions allow the package to be supported on a display hook.

17 Claims, 2 Drawing Sheets

MULTI-SEAL RECLOSABLE FLEXIBLE PACKAGE FOR DISPLAYING THINLY SLICED FOOD PRODUCTS

This application is a continuation of application Ser. No. 930,491, filed Aug. 14, 1992, now abandoned, which application was a continuation of application Ser. No. 609,296, filed Nov. 5, 1990, now abandoned, which application was a continuation-in-part of application Ser. No. 505,329, filed Apr. 5, 1990, now abandoned.

BACKGROUND AND SUMMARY OF THE PRESENT INVENTION

The present invention relates generally to recloseable flexible packages for hermetically sealing consumable products between generally opposing package films. More particularly, the invention relates to a flexible recloseable package having a formed food product cavity which is uniquely suited for packaging thinly sliced food products such as luncheon meats and a vertically extending portion disposed above the formed product cavity which contains one or more openings to accommodate a hook member for the vertical display of the package in a manner such that the package provides the consumer with the ability to observe both sides of a stack of shingled, sliced food products.

The freshness of food products such as bacon, sliced luncheon meats, cheeses and the like which are sold prepackaged to consumers-depends upon the extent to which the package is vacuum-packed or gas-flushed and subsequently hermetically sealed. Often, the purchaser does not use the food products contained within such packages at once, but rather uses them over an extended period of time. When the initial hermetic seal of the package has been breached during the opening thereof, a portion of the total amount of packaged product is often removed. In such instances, the package cannot be effectively sealed if it does not have a recloseable seal to preserve the freshness of the food product stored therewithin. The purchaser must then repack the food products in a different suitably recloseable container.

Additionally, many prepackaged food products have their package seals located close to the vertical edge of the package. From a marketing standpoint, such a package cannot be displayed on a vertical product display, because any display opening would be positioned beneath the package seal and destroy the integrity of the seal.

Further, many food products are often presliced and packaged in either an ordered stack wherein only the front face of the first slice can be viewed from the package exterior or wherein the slices are randomly arranged or "jumbled" within the package. Moreover, such packages can not be effectively used to hold thinly sliced food products such as luncheon meats within the package. Thinly sliced food products of the type suitable for packaging according to the present invention can be defined as including between about 22 and 36 slices per inch of the vertical height of the food product stack. With this slicing parameter, the resultant slices are somewhat delicate in nature and are prone to tearing and disassociating when not properly supported. With such tearing, thinly sliced luncheon meats currently commercially available are often packaged in a somewhat disorganized manner between opposing flexible package panels. The haphazard manner in which these food products are displayed and viewed by the consumer may create a lack of confidence therein by a consumer in that the slices appear to be overly processed and of poor quality. By arranging the thinly sliced food products in a neat shingled stack and retaining the stack in an aesthetically pleasing position within a flexible package product cavity in a manner so such that both of the front and rear surfaces of the shingled stack are viewable from the outside improves the consumer perception of such food products.

Accordingly, a need exists for an improved food product package of the type having multiple seals which can be easily displayed in a vertical setting and which contains a formed product cavity which product cavity vertically displays a stack of thinly sliced food products so that front and rear faces of the food product stack are visible through the front panel of the package.

The improved packages of the present invention provide significant advantages in that one of the two package flexible films has a food product cavity formed therein which is tapered such that the product cavity film has a substantial portion which is inclined with respect to its covering film. The cover package film is hermetically sealed to the product cavity film around the entire periphery of the tapered product cavity. This package first seal is hermetic and is positioned interior of a package second seal in the form of a recloseable seal assembly so that the package is liquid tight and suitably retains within the package, the fluids of the products contained therein, including water, juices, oils and the like. The recloseable seal assembly is positioned above the package hermetic seal on two opposing faces of vertically extending package portions of the two package films and therefore the package can be opened and closed repeatedly to remove a portion or all of the package contents without destroying the integrity of the package. A "zipper" seal consisting of interengaging components such as rib and groove fastener elements is the preferred recloseable seal means. The vertically extending package portions contain openings extending through the panels above the recloseable seal assembly which permit the packages to be arranged for display, such as by hanging from a peg or hanger or the like in which the thickest depth of the tapered product cavity accommodates a folded-over portion of a shingled stack of thinly sliced food products and wherein the thinner depth section of the tapered product cavity accommodates the shingled edges of some of the shingled, folded slices.

The hermetic seal disposed on the two package film panels around the periphery of the product has an easy open or "peel" seal portion located adjacent to the product and interior of and below the recloseable seal. The recloseable seal is opened with digital pull-apart forces which are also used to open the peel seal. The peripheral hermetic seal can maintain a vacuum, pressurized and/or gas-flushed environment within the package.

The recloseable seal components of the packages of this invention are attached to confronting faces of the vertically extending portions of the two opposing package films. The two interengaging fastener elements are firmly anchored to the opposing package panels and are permanently sealed together at their opposite ends, which decreases the possibility that the package panels may tear or separate when the hermetic seal is opened.

A third package seal which is tamper-evident is formed by the opposing vertically extending portions by sealing their tops together to form a tamper-evident strip which must be removed or broken to gain access to the package first and second seals.

Accordingly, it is an object of the present invention to provide an improved recloseable flexible package for use with stacks of sliced food products, which package has a first, hermetic peel seal disposed peripherally adjacent to the products and a second, recloseable seal disposed exterior of the hermetic seal.

Another object of the present invention is to provide a multi-seal recloseable package for food products and the like having a first hermetic seal located between two opposing package panels and having a peelable seal area adjacent to and interior of a second recloseable seal located between two vertically extending package portions which forms a recloseable mouth of the package, and a third, permanent seal located above and exterior to the recloseable seal at the package top.

Yet another object of the present invention is to provide an improved recloseable package for sliced food products having a formed product cavity wherein the product cavity is tapered such that the depth of the same decreases as the product cavity approaches the top of the package, and wherein recloseable seal elements are attached to extending portions of two opposing package panels disposed above the product cavity, and the extending portions have means for supporting the package on a vertical display.

Still another object of the present invention is to provide an improved package for sliced food products having a peelable hermetic seal disposed around the periphery of the food product on a peripheral margin of a formed product cavity interiorally adjacent a recloseable seal, the recloseable seal extending laterally between package ends exterior of the peelable seal, a portion of the package containing the recloseable seal having means to accommodate peg board display hooks and a permanent seal exterior of the recloseable seal and peg board mounting means having tamper-evident means thereon, and wherein the sliced food products are displayed so as to permit the texture and muscle definition of at least some of the slices to be viewed from the outside of the package.

These and other objects of the present invention will become more readily apparent from a reading of the following detailed description.

BRIEF DESCRIPTION OF THE DRAWINGS

In the course of this description, reference will be made to the attached drawings wherein.

DETAILED DESCRIPTION OF THE INVENTION

Figure 1:
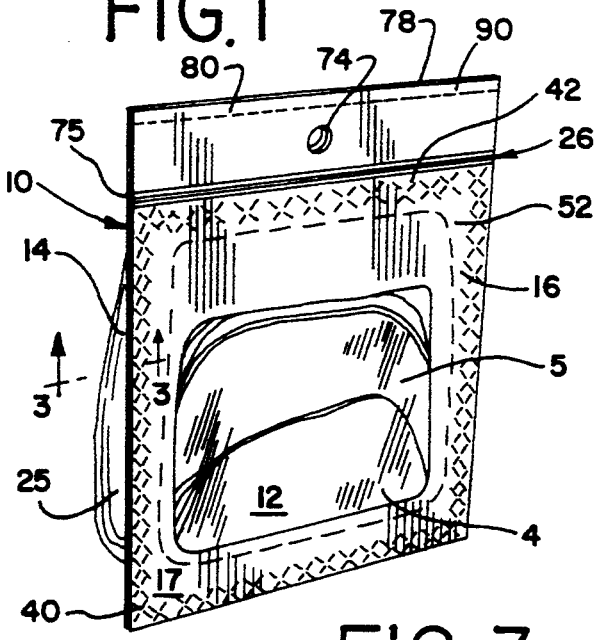
FIG. 1 is a perspective view of one embodiment of a package incorporating the principles of the present invention. For purposes of illustration only, the package is shown as containing vacuum-packed luncheon meats.

FIG. 1 illustrates a recloseable package 10 constructed in accordance with the principles of the present invention. The packages 10 of the present invention are particularly suitable for sealing a perishable food product, shown in FIGS. 1 and 2 as luncheon meat slices 12, between a first, formable package panel 14 and a second, non-formable package panel 16. The first and second package panels 14 and 16 which form the two sidewalls of the package 10 can be made from a variety of materials including plastic films, plastic films with heat sealable coatings, multi-layered laminates and/or co-extrusions, thermoformable materials and the like. A preferred plastic film for assembly of the packages of the present invention is one which substantially is impervious to air, oxygen and/or moisture.

Figure 3:
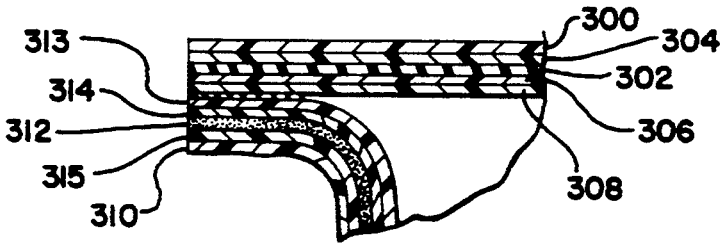
FIG. 3 is an enlarged, cross-sectional view of the package of FIG. 1 taken along line 3—3.
Figure 4:
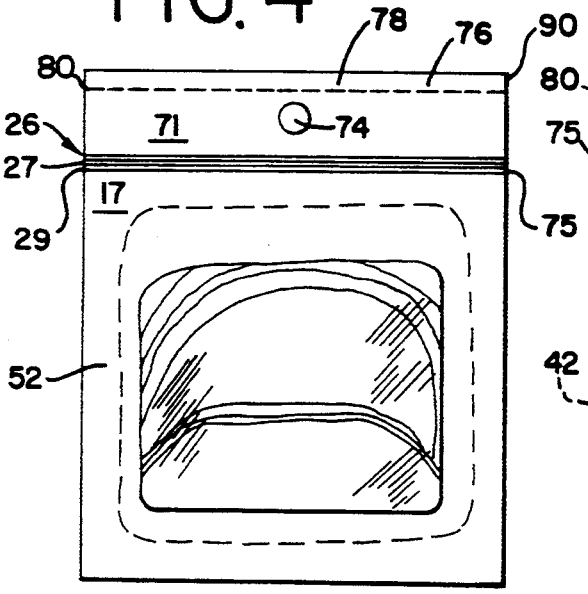
FIG. 4 is a front elevation view of the package of FIG. 1.
Figure 5:
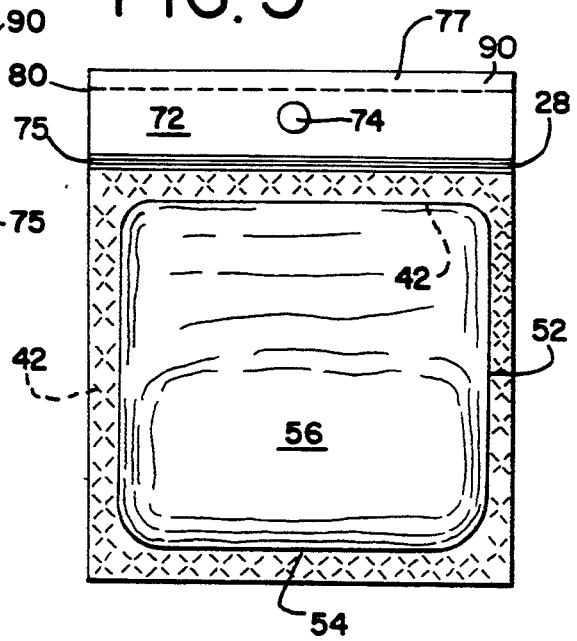
FIG. 5 is a rear elevational view of the package of FIG. 2.

When one or more of the package panels 14, 16 is formed from a multi-layered construction, it is desirable to use a thin, inner layer which is substantially impervious to air, oxygen and/or moisture in combination with an outer layer having sufficient flexibility and desirable structure characteristics so that the laminate can function as a package panel. For purposes of illustration and discussion, the package panels depicted as flexible sheets will be shown as a single, heat-sealable lamina. In actual practice, each flexible package panel will likely be a co-extrusion and/or laminate of two or more layers which will provide sufficient protection to the product (e.g., oxygen and moisture barriers) and which conform a hermetic, and if desired, peelable seal at the inner surfaces. As is known in the art, multi-layered films particularly suitable for use with the second, non-formable or covering panel 16 are those utilizing three layers. As is shown in FIG. 3, the outer layer 300 can be a tough polymer, such as a printable polyester, for example, one having a thickness of about 0.5 mils. Enhanced oxygen barrier properties can be achieved by an inner layer or barrier coating 304, 306, such as a coating of polyvinylidene chloride ("Saran") or of an ethylene vinyl alcohol copolymer (EVOH film) which is applied to the interior surface of the exterior layers 300, 308. When printing is desired, a package ink 302 or the like is most advantageously printed onto either of the inner barrier layers 304, 306. The inner layer 308 preferably contains a sealant layer or film such as polyethylene, Surlyn ionomer, ethylene vinyl acetate copolymer (EVA) and the like having a typical film or sealant thickness of about 2 mils.

Similarly, the formable web or first panel can be made of a multi-layered material well-known in the art for their flexibility and forming characteristics and which can be run on a form-fill-seal machine. A suitable first panel outer layer 310 can be a polyamide material, a polypropylene or a polyester. Barrier coatings 314, 315 similar to the inner layers 304, 306 of the cover panel 16 may also be typically provided. Generally, the outer layer materials are transparent and where the forming web or first panel 14 is to be non-transparent, an intermediate coloration layer such as an ink layer 312 is disposed on the inner surface(s) of either of the inner or outer layers 310, 313. The inner layer 313 of the forming web can incorporate a sealant film such as polyethylene, Surlyn ionomer, ethylene vinyl acetate copolymer (EVA) which are desirable because of their inherent capabilities to provide the necessary hermetic, and peelable, seal. Exemplary materials suitable for such a layer are copolyesters such as polyvinylchloride, Barex ® and other polyester components.

Returning to the Figures, the package 10 has one package panel 14, in the form of a generally rectangular flexible, formed first film panel 14 having a formed product cavity 18, into which is placed a plurality of food product slices 12. The slices 12 are enclosed within the tapered product cavity 18 by an opposing package or cover panel 16, illustrated as a flexible film sheet 17.

The luncheon meat slices 12 or the like are desirably positioned in a generally tapered product cavity 18 within the projecting walls 50 of the product cavity 18 having a generally wedge-shaped or "bubble" configured compartment 25. The projecting walls 50 are typically formed integrally within the first film panel 14 such as by thermoforming or vacuum forming. A peripheral flange 52 surrounds the wedge-shaped or bubble compartment 25 and provides a surface to which the second or covering film panel 16 can be adhered to.

The configuration of the product cavity 18 is important in that it includes a bottom wall portion 54, a tapered or inclined back wall portion 56 which are joined together to form the product compartment 25. Thus, within the wedge-shaped compartment 25, the bottom wall 54 defines the compartment maximum depth (or front-to-back package dimension) while the top of the rear wall 56 defines the compartment minimum depth. In this manner, the depth of the compartment 25 decreases as the tapered rear wall 56 approaches the top of the package 10.

Figure 2:
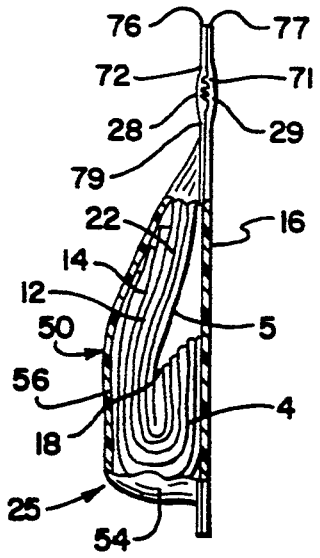
FIG. 2 is a side view, partially broken away of the package of FIG. 1, and showing shingled and folded slices of food products therein.

With this structure, the product compartment 25 is especially suited for enclosing a shingled stack 22 of thinly sliced food products 12 which stack has been folded over onto itself in the manner best shown in FIG. 2. When folded over, the food product stack 22 has a generally U-shaped and solid bottom portion having a substantial thickness and somewhat planar shape which generally conforms to the shape defined by the product cavity 18. The inclined rear wall 56 of the product compartment 25 helps to support the upper portion of the folded stack 12, which is in need of support due to the shingled nature and thickness thereof, while the bottom wall 54 thereof supports the bottom portion of the folded stack 12. With this structure, a portion of both sides or faces 4, 5 of the shingled stack 12 of food products can be advantageously viewed through the second or cover film panel 16, and therefore permits clear viewing of a substantial portion of both faces of the sliced product which rests against the tapered wall 56 of the product compartment 25.

Because the product 12 intended to be stored in the product cavity 18 takes the form of a plurality of very thinly sliced items, any one of which would not readily remain in place without the support provided by the other slices, the food products can be sliced as thin as between 22 and 36 slices per inch and still be packaged without creating an undesirable visual impression of the sliced food products. With the present invention, the thinness of the food product slices facilitates the folding of the slices onto themselves in the shingled, generally U-shaped configuration illustrated in FIG. 2. With this arrangement, even though the individual slices are unusually thin for many packaged food products, approximately one-half of one of the slices 11 is visible through and rests against the package second panel 16.

After the product cavity 18 is formed in the first film sheet 16, the first and second film sheets 14 and 16 are combined by contacting each other around the product cavity peripheral flange 52. The first and second film sheets 14, 16 are contacted in a manner so that a continuous edge seal 40 is achieved therebetween along the product cavity peripheral margin 52. A portion 42 of the hermetic seal 40 is peelable in nature to maintain a secure seal during handling and storage that can be peeled back upon the application of digital forces applied through an outer recloseable seal 26 or the like.

The package has a first outer recloseable seal 26 illustrated as a conventional interengaging fastener assembly 27 such as a rib and groove fastener assembly. Although the interengaging fastener assembly 27 is illustrated as one that is particularly secure for the illustrated type of package 10, namely, having a length of a formed single rib 28 and a similar length of a formed groove 29, it will be noted that the interengaging fastener elements 28, 29 of the recloseable seal 26 are not limited to any particular number of interengaging fastener elements. The rib element 28 need only project outwardly therefrom a sufficient distance to be securely interengaged with and held by its confronting and complimentary groove element 29 by two outwardly extending walls defining a channel or groove therebetween. The groove is of sufficient width to firmly engage the rib when the confronting interengaging fastener elements 28, 29 are pressed together. Both the recloseable seal 26 and the interengaging fastener assembly 27 can take any number of various characteristics and configurations in addition to those described herein.

Figure 6:
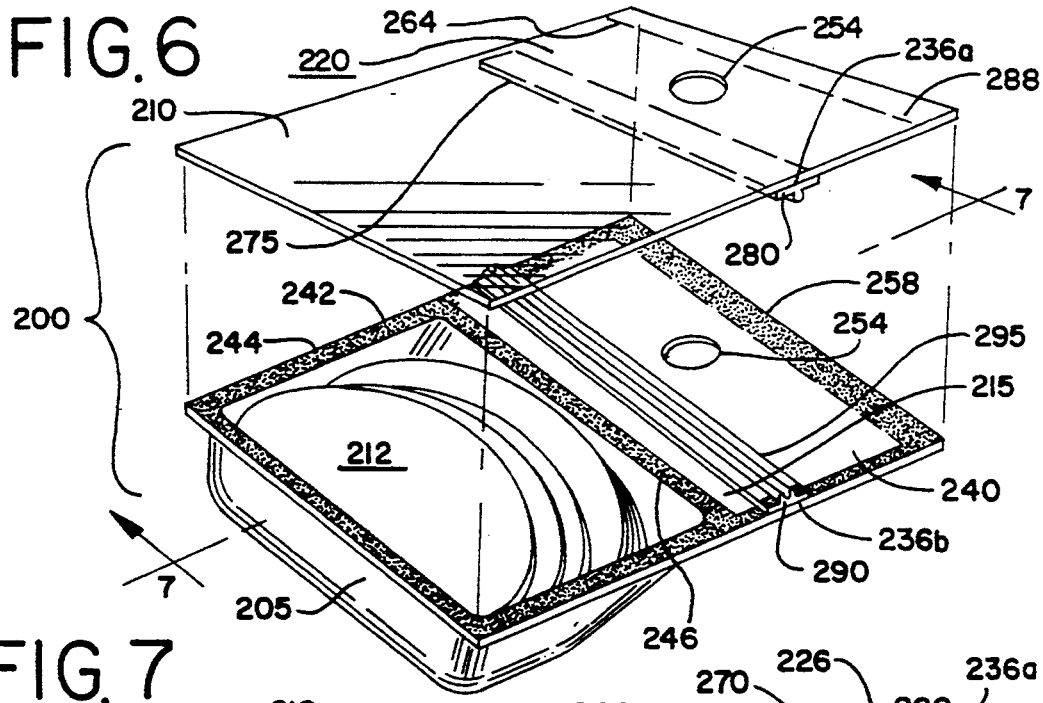
FIG. 6 is an exploded perspective view of a second embodiment of a package incorporating the principles of the present invention.
Figure 7:
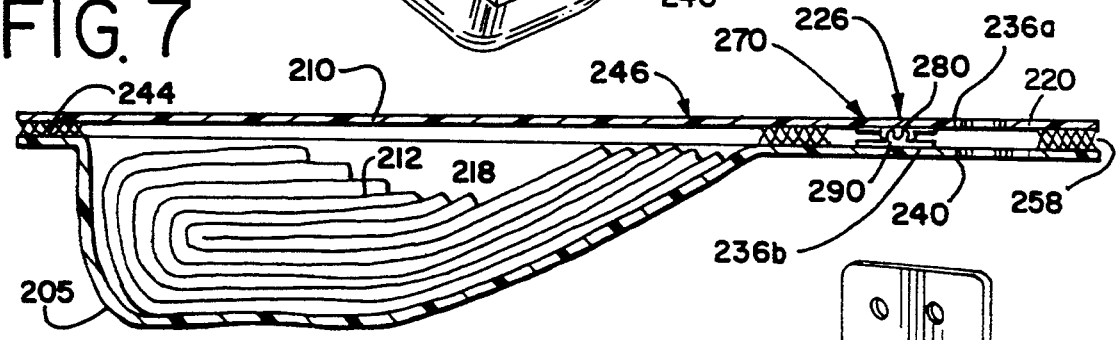
FIG. 7 is a cross-sectional view of the package of FIG. 6 in an assembled state; and, FIG. 8 is a perspective view showing the packages of FIG. 6 displayed on a hook.
Figure 8:
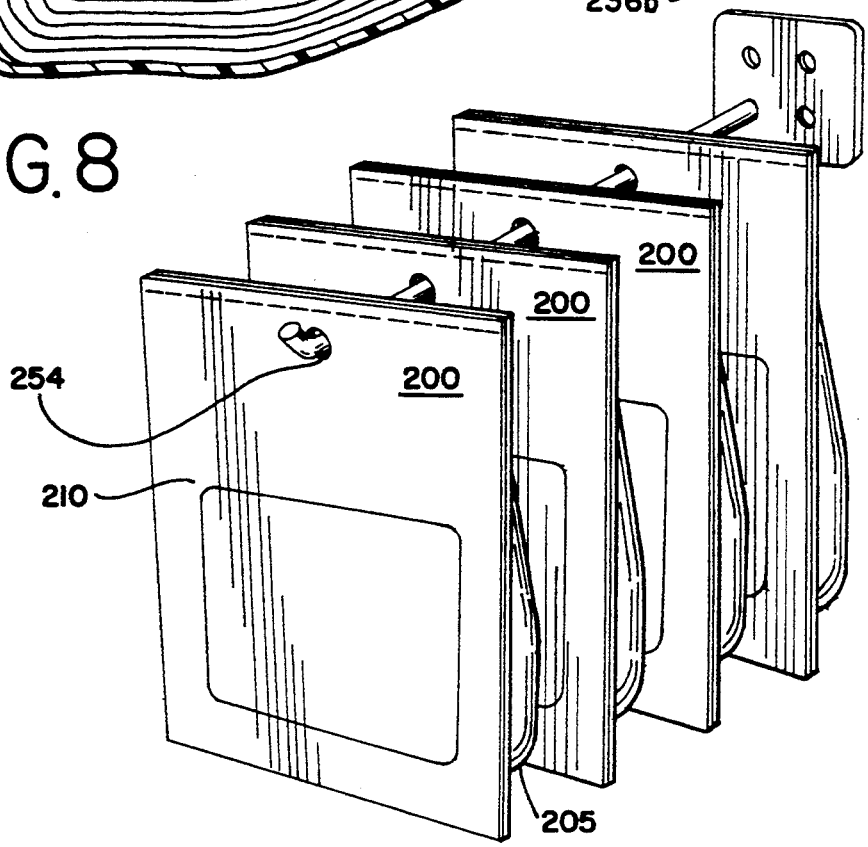

Although the two confronting interengaging fastener elements 28, 29 are shown in FIGS. 1–5 as being extruded integrally with the package panels 14, 16, the fastener elements may also be formed as separate members as shown in the embodiment 200 illustrated in FIGS. 6–7. In such instances, the two confronting interengaging fastener elements 280, 290 are separate members, and the rear surfaces thereof may include attachment means in the form of sufficiently wide flanges **236*a*, 236*b* which extend transversely to the fastener elements 280, 290, to provide appropriate surfaces to adhere and seal the recloseable seal fastener elements 280, 290 to the opposing film sheets 205, 210. The flanges 236*a*, 236*b* may be as wide as the vertically extending portions 220, 240 to provide reinforcement thereto. Where the interengaging fastener assembly 270 utilizes separate interengaging opposing fastener elements 280, 290, the fastener assembly 270 may be applied to the confronting surfaces of the flexible film sheets 205, 210 by conventional means such as a suitable adhesive, heat sealing, ultrasonic welding or the like. The interengaging fastener assembly 270 is preferably of the same length as the two film sheets 205, 210 and the interengaging fastener elements 280, 290 are further attached together at their opposite ends 275 so that the fastener material is not wasted in the trimming of the package 200, and so that it does not interfere with the peripheral hermetic seal 244 of the package 200**.

Returning now to the first embodiment shown in FIGS. 1–5, the package panels 14 and 16 each significantly include an integral vertical package extension 71, 72 which extends exterior of and above the recloseable seal 26. These integral package extensions 71, 72 have a sufficient vertical extent to accommodate a means for supporting the package 10 on a vertical display, shown as openings 74. The openings 74 are configured to receive a peg board display element and are preferably positioned within the vertical extensions above the recloseable seal 26. Although the vertical package extensions 71, 72 may each be only long enough to accommodate the display openings 74 and any tamper-evident seal as will be explained later, they may be of substantial width, so that either the front or rear panels thereof may be imprinted on its inside or outside surface with desirable information such as merchandise source, description, price information, advertising or the like.

The free ends 76, 77 of the vertical package extensions 71, 72 are secured together by suitable generally permanent bonding means shown as a permanent package third seal 78 located exterior of and above both the package second recloseable seal 26 and the package mouth 79. The tamper-evident seal of the package is further defined by a line of weakening 80 shown as perforations, extending longitudinally within the extensions 71, 72 generally adjacent to the recloseable seal 26. The line of weakening 80 can be administered in any suitable manner such as perforations or scoring. The free ends 76, 77 of the extensions 71, 72 which are sealed together thereby serve as a package tear strip 90 which will indicate prior opening of the package 10. If desired, an additional line of weakening may be provided in order to facilitate opening of the package 10 by grasping the tear strip 90 in one hand and the package body in the other hand. By this structure, access which permits opening of the recloseable, second seal fastener elements 28, 29 is possible only upon breaking the third seal by severance or ripping of the tamper-evident strip 90.

The embodiments illustrated are advantageous because they are specially suitable to be formed, filled and sealed on existing machinery, requiring minimal modifications to the package machinery and/or material used in forming packages having reclosure strips. In addition, these embodiments provide easily understood tampering indicators while requiring no other, separate tamper-evident component, inasmuch as the package extensions perform the tamper-evident feature. As best seen in FIG. 1, it is desirable to make a portion 42 of the hermetic seal 40 which is beneath and interiorally adjacent of the recloseable seal 26, a peelable seal to allow the purchaser simple and easy access to the product. The hermetic seal 40 may be entirely of a peelable nature with the hermetic seal portion thereof having a stronger bond effected between the covering film 16 and the product cavity film 18 than in the peelable seal portion 42 interior of the recloseable seal 26, so that the hermetic seal 40 is, for all intents and purposes non-peelable. In any event, because the hermetic seal 40 is positioned interior of the recloseable seal 26, the likelihood of "leakers", i.e., packages wherein air enters and the product juices or oils escape from the product cavity 18 and enter the recloseable seal area 26, is greatly diminished.

During production of packages of the present invention, the product cavity 18 may be formed by any conventional method in the product cavity film sheets 14, 218 such as by thermoforming. The fastener elements 28, 29 may be formed integral with the opposing film sheets or may be applied as a continuous strip of the recloseable seal interengaged fastener elements 280, 290 may be fed and applied to the access edge 215 of a continuous length of either the cover or product cavity film sheet and sealed thereto after the food product 12, 212 has been loaded into the food product cavity 18, 218 to form a product-panel assembly. A covering film 16, 210 is then positioned over the cavity of the product panel assembly and the peelable package seal 42, 246 is formed interior of the outer recloseable seal 26, 226. A vacuum is applied and then (not simultaneous) the product cavity 18, 218 is gas flushed, if desired. The opposing cover and cavity film sheets 14, 16 and 205, 210 are then permanently adhered to each other along their perimeters 42, 242 by heat sealing, ultrasonic welding or by adhesive or any other suitable means and further are adhered together at the edges of the package extension portions and 220, 240 to create the package hermetic seal 44, 244. The ends 275 of the recloseable fastener assembly are then permanently attached together and the tamper-evident strip 90, 288 is formed by sealing the package extension portions 71, 72,220, 240 together at 78, 258 which is subsequently perforated to form the package tear strip 90, 288.

Either before or after forming the package openings 74, 254 a package label (not shown) or other package graphics may be applied to the package vertical panels in any conventional manner.

When it is desired to open a finished package, the user grips the package extension permanent mouth seal 258 and tears it off along the line of weakening 264 to gain access to the recloseable seal 226. The vertical panel extensions 220, 240 serve as pull flanges and are gripped by the user who applies digital pull-apart forces to open the recloseable seal 226 and the interior peel seal portion 246 of the hermetic seal 244. The recloseable seal 226 will then separate and open, thereby allowing access to the inner peelable seal 246. The recloseable seal elements 280, 290 will open to form a package mouth. Due to the fact that the recloseable seal 226 is adhered to the package panels 205 and 210 at the ends 275 thereof, the likelihood of destruction of the integrity of the package 10 is greatly diminished.

It will be seen that while certain embodiments of the present invention have been shown and described it will be obvious to those skilled in the art that changes and modifications may be made therein without departing from the true spirit of the scope of the invention.

We claim:

1. A recloseable plastic film display bag package and packaged food product in which thinly sliced food products are positioned between generally opposing bag walls and at least one surface of the food products within said bag is viewable through the bag and the food product is hermetically sealed in said bag, said bag being defined by front and rear bag walls which are joined together on at least three sides thereof and which provide an openable mouth for said bag, said bag comprising, in combination:

a first flexible film forming said bag front wall;

a second flexible film forming said bag rear wall, the second flexible film having a generally wedge-shaped product cavity formed therein for holding the thinly sliced food products in a generally vertically viewable display position, said product cavity being defined by a peripheral flange of said second film extending around said product cavity, the peripheral flange having an access edge portion disposed proximate to the bag mouth, said product cavity having first and second opposing ends and further having a depth which decreases as said product cavity approaches said bag mouth, such that the depth of the first end of said product cavity is greater than the depth of the second end thereof;

a stack of thinly-sliced food products disposed in said product cavity and closely supported therein by and between said first and second flexible films in the viewable display position, said stack of thinly sliced food products being folded over onto itself to define a generally doubled-over stack of shingled, thinly-sliced food products, said stack having a configuration generally complementary in configuration to said product cavity, said doubled-over stack of thinly-sliced food products being positioned in said product cavity proximate to said first end thereof;

said first and second flexible films being bonded together around said product cavity at said peripheral flange and interior of and beneath a pair of opposed fastener elements, and so that said first flexible film is substantially planar, thereby forming a hermetic first package seal therebetween which seals said stack of thinly-sliced food products within said product cavity and between the substantially planar first flexible film and said second flexible film, a portion of said hermetic first package seal proximate to said bag mouth being a peelable hermetic seal;

a recloseable second package seal formed by said pair of opposed fastener elements attached to opposing faces of said first and second flexible films above said product cavity, said opposed fastener elements being attached to each other at opposite ends thereof to define said bag mouth; and said first and second flexible films having integral, respective first and second bag extension panels disposed above said recloseable second package seal, the first and second bag extension panels having respective opposing faces sealed together at a permanent third package seal, said permanent third package seal including tamper-indicating means for indicating prior opening of said bag, the tamper-indicating means including a removable tear strip formed at said permanent third package seal, said tear strip being defined by one or more lines of weakening disposed in said first and second extension panels adjacently beneath said permanent third package seal.

2. The recloseable display bag and food product of claim 1, wherein said first flexible film is a multi-layered film sheet having a polyester outer layer, a sealant film inner layer and a gas-barrier intermediate layer therebetween, and said second flexible film is a shapable multi-layered film sheet.

3. The recloseable display bag and food product of claim 1, wherein said hermetic first package seal peelable seal portion is formed by way of adhering said first and second films together, said peelable seal portion being peelable upon the application of digital forces between 0.5 and about 7.5 pounds per inch.

4. The recloseable display bag and food product of claim 1, wherein each of said first and second flexible films are formed of flexible, oxygen-impermeable multi-layered package films.

5. The recloseable display bag and food product of claim 1, wherein said second flexible film is substantially non-transparent and said first flexible film is substantially transparent.

6. The recloseable display bag and food product of claim 1, wherein said product cavity is gas-flushed.

7. The recloseable display bag and food product of claim 1, wherein said generally wedge-shaped product cavity includes a bottom wall and a tapered back wall which are joined together at said product cavity first end, each of the bottom wall and tapered back wall engaging a portion of said doubled-over stack of thinly-sliced food products to support said stack in said viewable display position.

8. The recloseable display bag and food product of claim 5, wherein said second flexible film is a multi-layered film having a metallized film layer.

9. The recloseable display bag and food product of claim 1, wherein said thinly sliced food products are luncheon meat slices having a thickness of between about 22 and 36 slices per inch.

10. The recloseable display bag and food product of claim 1, wherein said first and second bag extension panels include support means for supporting said recloseable bag in a vertical display position such that said stack of thinly-sliced food products are displayed in said generally vertically viewable display position, said support means being disposed above said recloseable second package seal and beneath the permanent third package seal.

11. The recloseable display bag and food product of claim 10, wherein said support means includes at least one opening passing through said bag first and second extension panels, said opening being adapted to receive a display support member therethrough.

12. The recloseable display bag and food product of claim 1, wherein at least one of said bag walls is at least in part transparent.

13. The recloseable display bag and food product of claim 12, wherein at least two distinct surfaces of the food products in said bag are displayed.

14. The recloseable display bag and food product of claim 1, wherein at least two distinct surfaces of the food products in said bag are displayed.

15. The recloseable display bag and food product of claim 1, wherein one of said first and second panel extensions contains package identifying indicia.

16. The recloseable display bag and food product of claim 1, wherein said peripheral flange is substantially square.

17. The recloseable display bag and food product of claim 1, wherein said peripheral flange is substantially rectangular.

* * * * *

UNITED STATES PATENT AND TRADEMARK OFFICE

CERTIFICATE OF CORRECTION

PATENT NO. : 5,405,629

DATED : April 11, 1995

INVENTOR(S) : Todd S. Marnocha, Brian P. Lawless and Gerald O. Hustad

It is certified that error appears in the above-indentified patent and that said Letters Patent is hereby corrected as shown below:

On the title page, item [56], col. 2, in Patent No. 4,823,961, delete "2/1989" and insert --4/1989--.

Col. 1, line 30, delete the hyphen "-" between "consumers" and "depends".

Col. 4, line 55, delete "their" and insert --its--.

Col. 8, line 17, delete "72,220" and insert --72, 220--.

Signed and Sealed this

Twenty-ninth Day of October 1996

Bruce Lehman

*Attest:*

BRUCE LEHMAN

*Attesting Officer*

*Commissioner of Patents and Trademarks*